United States Patent [19]

Holt, Jr. et al.

[11] 4,240,503

[45] Dec. 23, 1980

[54] BLOWOUT PREVENTER SHEARING AND SEALING RAMS

[75] Inventors: James H. Holt, Jr.; Morris Newman, both of Houston, Tex.

[73] Assignee: Hydril Company, Los Angeles, Calif.

[21] Appl. No.: 34,982

[22] Filed: May 1, 1979

[51] Int. Cl.[3] ..... E21B 29/00

[52] U.S. Cl. ..... 166/55; 251/1 A

[58] Field of Search ..... 251/1 A, 1 R; 166/55, 166/55.1, 297; 30/92; 83/639; 277/92, 93 R, 95

[56] References Cited

U.S. PATENT DOCUMENTS

| | | | |
|---|---|---|---|
| 2,919,111 | 12/1959 | Nicolson | 166/55 X |
| 2,969,838 | 1/1961 | Wilde | 166/55 |
| 3,561,526 | 2/1971 | Williams, Jr. et al. | 166/55 |
| 3,590,920 | 7/1971 | Orund et al. | 166/55 |
| 3,736,982 | 6/1973 | Vujasinovic | 166/55 |
| 3,766,978 | 10/1973 | Orund et al. | 166/55 X |
| 3,817,326 | 6/1974 | Meynier | 166/55 |
| 3,946,806 | 3/1976 | Meynier | 166/55 |
| 4,132,265 | 1/1979 | Williams, Jr. | 166/55 |
| 4,132,266 | 1/1979 | Randall | 166/55 |
| 4,132,267 | 1/1979 | Jones | 166/55 |

*Primary Examiner*—Stephen J. Novosad

*Attorney, Agent, or Firm*—Pravel, Gambrell, Hewitt, Kirk, Kimball & Dodge

[57] ABSTRACT

Rams are provided in a blowout preventer to shear the drill string and seal the well bore should the need arise. Two shearing rams have cutting blades which shear the drill pipe. A seal member is mounted behind one of the cutting blades and is adapted to move into sealing position after shearing has occurred. Elastsomer flow into areas where there has been damage to the seal member is permitted by the design of the seal member.

31 Claims, 9 Drawing Figures

BLOWOUT PREVENTER SHEARING AND SEALING RAMS

BACKGROUND OF THE INVENTION

The present invention relates to ram blowout preventers and shearing and sealing rams therefor.

Prior art pipe shearing rams for shearing drill strings or drill pipe are shown, for example, in U.S. Pat. Nos. 2,919,111; 2,969,838; 3,561,526; 3,590,920; and 3,766,978. However, there has been some concern as to whether cut ends of pipe or debris resulting from shearing would hamper sealing action in these shearing rams.

U.S. Pat. Nos. 3,736,982; 3,817,326 and 3,946,806 have utilized a sealing element disposed on one of two shearing rams in the shearing plane to seal between the two rams when closed. In addition to shearing and sealing operations, it is often necessary to use these rams as "blind" rams in order to seal the bore without shearing any pipe. Concern has been expressed that the sealing element between the rams might extrude beyond the ram surface after several "blind" closures. Should a need to shear drill pipe then arise, the sealing element would be exposed to damage by the sheared drill pipe. Further, the sealing element between the blades was energized by lateral movement of elastomer. Due to frictional forces, sealing pressure on the elastomer towards the center of the sealing element was reduced from that at the outer portions.

In the structure of U.S. Pat. No. 3,736,982, a lateral sealing element between the two shearing ram surfaces was energized when a ram block of an upper ram of the two rams was contacted by the lower ram. However, if drill pipe contacted the ram block during shearing, energization of the seals occurred. Thus, the lateral sealing element could be moved into a position where it was subject to damage by the sheared drill pipe. Additionally, the lateral sealing element was limited in size to a small lateral reservoir slot in one ram, and if damage by the sheared pipe was large, insufficient elastomer might be present in the reservoir to effect a seal between the two rams.

SUMMARY OF THE INVENTION

Briefly, the present invention provides new and improved blowout preventer rams for shearing drill or well pipe or other objects in a blowout preventer bore and for sealing the bore. The rams may also be used as blind rams for sealing the bore in the absence of objects in the bore.

The sealing ram is used to seal the bore in conjunction with another ram and includes a carrier block for moving a shearing blade to and from the bore and a sealing member having a lower sealing portion which moves downward to seal with the other ram. An upper forcing portion of the sealing member responds to movement between the two rams to force the lower sealing portion downwardly. The two portions of the sealing member are spaced from each other by a transverse separation slot which forms planar contact surfaces between these portions of the sealing member. The separation slot permits transverse flow of the material of the forcing member in response to relative movement between the rams to be transferred into downward flow of the material of the sealing portion of the sealing member.

The rams of the present invention also provide new and improved structure for mounting the shear blade to the carrier block to resist forces imposed during shearing which might misalign or damage the shear blade and impair the effectiveness of shearing.

DESCRIPTION OF THE PREFERRED EMBODIMENT

Figure 1:
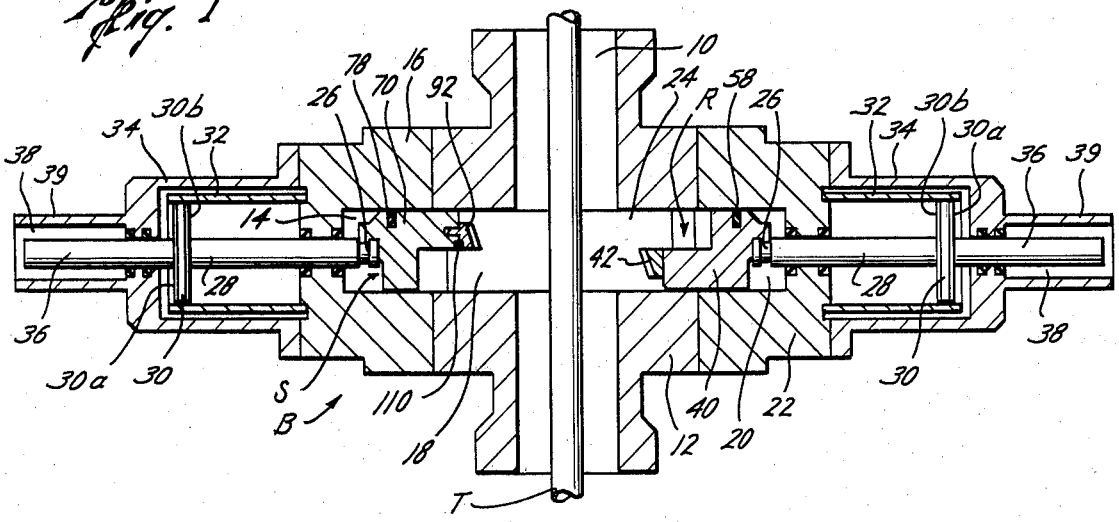
FIG. 1 is a vertical sectional view of a blowout preventer with shearing and sealing rams according to the present invention.

In the drawings, the letter B (FIG. 1) designates generally a blowout preventer according to the present invention. The blowout preventer B has a bore 10 formed through a body member 12 thereof, for passage of a well object T, which may be well tubing, well tools or other like objects, therethrough in the known manner for well operations. The blowout preventer B is constructed so that it is positioned in a stack of blowout preventers or in a string of well casing or pipe in any suitable manner, as will be well understood by those skilled in the art. As will be set forth below, the blowout preventer B of the present invention permits the bore 10 of the well to be sealed without requiring that the object T be removed therefrom, by shearing the object T and thereafter sealing the well bore across the surfaces along which shearing of the object T takes place.

The blowout preventer B includes a shearing and sealing ram S, which in conjunction a shearing ram R shears the object T in the bore 10. As will be set forth below, sealing structure on the ram S thereafter seals the bore 10 between the rams R and S against well pressures. The ram S and ram R are also adapted to seal the bore 10 without shearing when there is no object present therein.

The ram S is mounted in a recess 14 formed in a bonnet 16 mounted with the body member 12. The recess 14 is aligned with an opening 18 in the body member 12 transverse to the bore 10 so that the ram S may move transversely into the bore 10 to shear the object T in conjunction with the ram R.

Similarly, the ram R is mounted in a recess 20 formed in a bonnet 22 mounted with the body member 12 on an opposite side thereof from the bonnet 16. The recess 20 is aligned with an opening 24 in the body member 12 transverse to the bore 10 and in alignment with the recess 14 and opening 18 so that the ram R may move transversely into the bore 10 and shear the object T in conjunction with the ram S.

The ram S and the ram R are each mounted at an inner end 26 of a ram piston shaft 28 of a ram carrier piston 30. The ram carrier pistons 30 are each mounted within a support sleeve 32 within a ram cylinder 34. The ram cylinders 34 each receive operating fluid pressure therein through conventional fluid conduits, either integrally formed in the body member 12 or as separate fluid conduits with ported inlets into the cylinders 34. Closing operating fluid pressure is introduced into the cylinder 34 to act on a rear face 30*a* of each ram carrier piston 30 to move the ram S and the ram R inwardly into the bore 10 to shear the object T and thereafter seal the bore 10. Opening operating fluid pressure is introduced into the cylinder 34 to act on a front face 30*b* of each ram carrier piston 30 to move the ram S and ram R outwardly from the bore 10 to open the bore 10 when it becomes desirable to do so. Suitable seals are provided in the cylinders 34, such as with the ram carrier piston 30 to prevent leakage of operating fluid pressure between the faces 30*a* and 30*b* of the piston 30, and other fluid leakage, as will be understood by those skilled in the art.

Each of the ram carrier pistons 30 has a piston tail shaft 36 extending outwardly therefrom into an opening 38 of an end cylinder 39 mounted with the ram cylinder 34. The piston tail shafts 36 move inwardly and outwardly with respect to the openings 38 of the cylinders 39 during movement of the ram S and the ram R in the blowout preventer B. The blowout preventer B may also be provided with suitable automatic or manual ram locks, as well be understood by those skilled in the art, which are, however, not shown in the drawings to preserve clarity therein.

Figure 3:
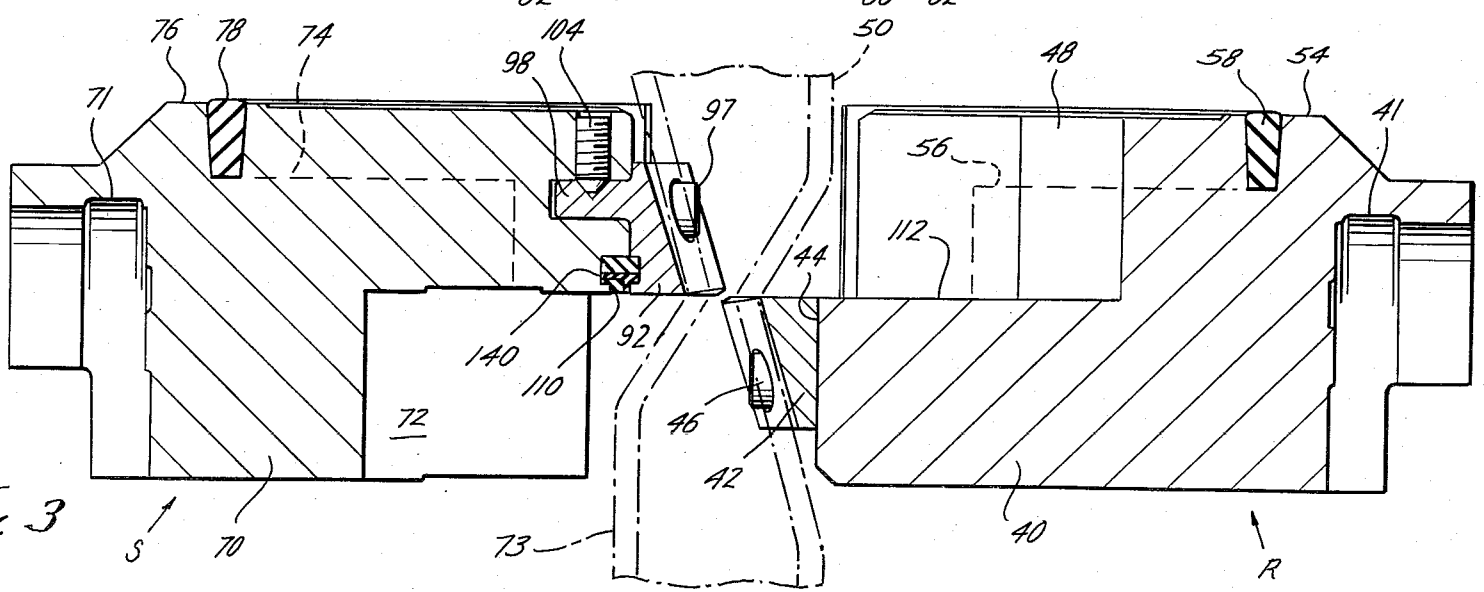
FIG. 3 is a cross-sectional view of the rams of FIG. 2.
Figure 4:
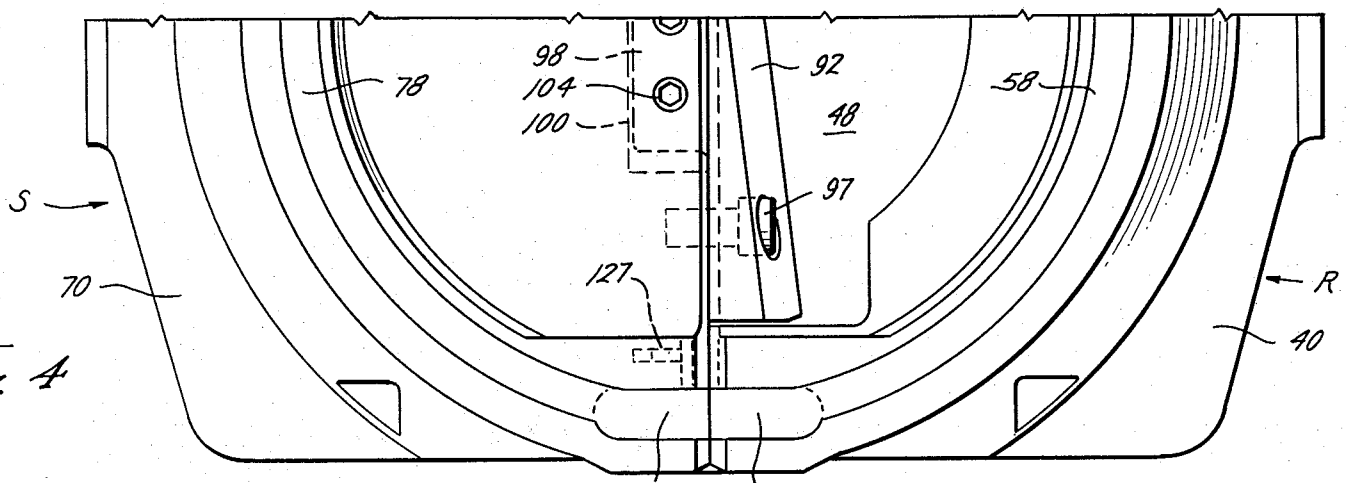
FIG. 4 is a partial plan view of the rams of FIG. 1 in position for sealing a well bore subsequent to shearing an object.
Figure 5:
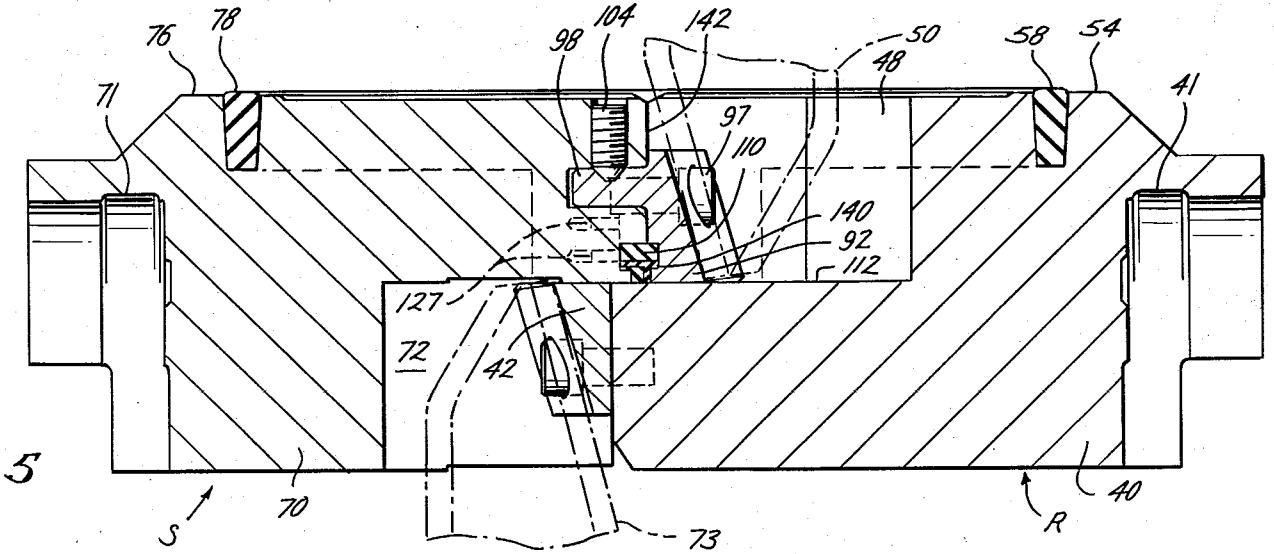
FIG. 5 is a cross-sectional view of the rams of FIG. 4.

Considering the rams R and S, such rams are shown in a half or partial plan view in FIGS. 3 and 5, it being understood that other portions of such ram are of like construction to the portions shown. The ram R includes a carrier block 40 (FIG. 3) with a rear socket 41 for receiving a button formed at the inner end 26 of ram piston shaft 28. The carrier block 40 has a lower shearing blade member 42 mounted therewith on a lower inner face portion 44 by means of fastener screws 46 or other suitable attaching means. The lower blade member 42 is adapted to shear the object T in conjunction with a blade on the ram S to be set forth.

A clearance pocket or space 48 is formed in the carrier block 40 above the inner portion 44 to receive a stub 50 or cut upper end of the object T. A threaded socket may be formed in an upper surface 54 of the block 40 to receive a connector screw so that the ram R may be removed from the blowout preventer B for service, repairs or the like.

An annular sealing pocket 56 is formed in the upper surface 54 of the block 40 to receive a generally horseshoe-shaped sealing member 58 formed of a suitable sealing elastomer material. The sealing member 58 forms a seal about the upper periphery of the ram R with the body member 12. Enlarged head or front seal portions 60 of the sealing member 58 are formed in front pockets 62 in inner portions on each side the block 40 to engage similar structure on the ram S, to be set forth, and form vertical seals between the ram R and S in the bore 10.

Contact faces 64 are formed on inner front face portions of the block 40 adjacent seal portions 60 to engage sealing structure on the ram S during relative movement between the rams R and S after shearing of the object T in order to assist in forming a transverse seal, in a manner to be set forth, across the bore 10 between the rams R and S in the plane where shearing of the object T has occurred.

Considering the ram S more in detail (FIG. 3), a carrier block 70 has a socket 71 formed therewith for connection with a button formed at the inner end 26 of the ram piston shaft 28. A lower clearance pocket or space 72 is formed in the carrier block 70 to receive a stub or lower cut end 73 of the object T (FIG. 5). An annular sealing pocket 74 is formed in the carrier block 40 at an upper surface 76 for receiving a suitable sealing elastomer 78, of a generally horseshoe-shaped configuration, typically synthetic rubber, to form a seal between the upper periphery of the ram S and the body member 12 about the periphery of the bore 10.

Figure 6:
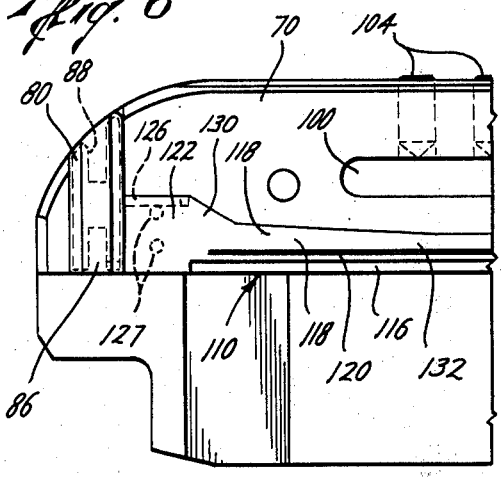
FIG. 6 is a cross-sectional view of one of the shearing and sealing rams of FIG. 1.
Figure 6A:
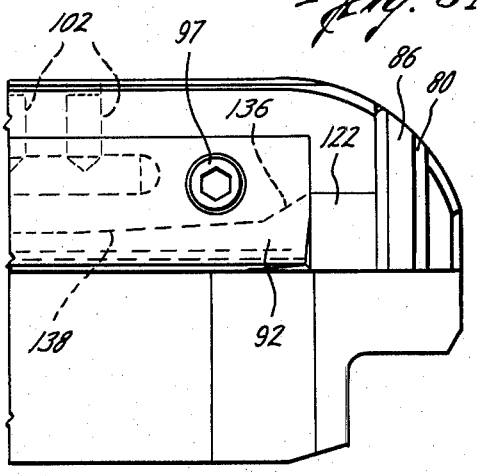
FIG. 6A is a front elevation view of the ram of FIG. 6.

Enlarged head or front portions 80 are formed on the sealing member 78 of a suitable sealing elastomer in front pockets 82 in the block 70 to engage the head portions 60 in the sealing member 58 of the ram R to form vertical seals along the bore 10 between the rams S and R. Vertically extending protuberant ribs 86 are preferably formed on front faces of the front portions 60 and 80 to insure elastomer flow to affect a firm seal with the body 12 by sealing members 58 and 78. Also, typically stiffener members of a suitable configuration, such as those shown in phantom at 88 (FIG. 6) are formed in the seal members 58 and 78 in the head portions 60 and 80, respectively, by being bonded therein for increased strength of such seal members.

The ram S further may also include a threaded socket formed in the upper surface 76 of the block 70 to receive a suitable connector screw or the like so that the ram S may be removed from the blowout preventer B for service, repairs or the like.

The ram S further includes an upper shearing blade 92 mounted on an inner portion of the block 70 on an upper face portion 96 by means of fastener screws 97 or other suitable attaching means. The upper shear blade 92 has a rearwardly extending tongue member 98 formed therewith which is adapted to fit within a transversely extending slot 100 (FIG. 6) formed in the upper face portion of the block 70. A plurality of downwardly extending threaded openings 102 are formed in the upper surface 76 of the carrier block 70 and extended downwardly so that set screws 104 may be inserted therein to engage the tongue member 98 of the shear blade 94 (FIG. 3). The mounting arrangement between the tongue member 98, the slot 100 and the screws 104 provides an important function. During shearing operations, it is very important that the spacing between the shear blades 92 and 42 of the rams S and R, respectively, be maintained within an acceptable tolerance in order to assure proper shearing action. Should the spacing between the two blade members become excessively large, the object T would become very resistant to shearing forces, and the rams S and R might not be able to exert sufficient shearing forces to shear such an object. By means of the set screws 104, the mounting of the blade member 92 on the ram S may be adjusted so that the spacing between the blade members 92 and 42 can be established at the desired spacing required for proper shearing between the rams S and R. Further, the rearwardly extending tongue member 98 of the shear blade 92 provides an additional function, namely providing strength for the blade member 92 in order to resist any bending or twisting moment exerted thereon by the upper portion of the object T during shearing operations.

A lateral seal member 110 is mounted in the ram S between the carrier block 70 and the shear blade 92 across the width of the ram S and is adapted to be moved into engagement with an upper surface 112 of the ram R to form a seal transversely between the ram S and R across the bore 10. The seal member 110 in conjunction with seal members 58 and 78 thus seals the bore 10 against well pressures.

The seal member 110 is formed from a suitable elastomeric material and includes a lower sealing member 116 which is mounted at a recessed position from the surface 114 during shearing operations and thereafter moves downwardly into contact therewith to form the seal between the rams S and R transversely across the bore 10. The seal 110 further includes an upper forcing portion 118 which is spaced from the lower sealing portion 116 by a transverse separation slot 120 (FIGS. 6 and 7), for reasons to be set forth. It is to be noted that the seal member 110 is at a recessed position within the ram S during shearing operations to reduce the risk of damage or scoring by cut ends of the object T or other debris.

The seal member 110 further includes side contact pads 122 which extend outwardly from the carrier block 70 adjacent side portions 124 of the shear blade 92. The contact pads 124 are adapted to be engaged by the contact faces 64 of the ram R after the object T has been sheared, so that relative movement between the rams S and R can be used to cause movement of the material of seals 58 and 78 to seal with the body 12 of the blowout preventer B and also downward movement of the portion 116 of the seal member 110 to form the seal between the rams S and R.

A stiffener member 126 is bonded within the contact pads 124 adjacent an upper end thereof to prevent upward extrusion of the elastomer material of the contact pads 124 when engaged by the contact faces 64.

A plurality of stiffener pins 127 are mounted within the contact pads 124 to provide structural support for the seal member 110, with a rear portion extending rearwardly therefrom for insertion into matching sockets formed in the front face of the carrier block 70 in order to support the seal member 110 in position between the carrier block 70 and the shear blade 92. The sealing portion 116 and the forcing portion 118 are integrally connected with the contact pads 124 so that the sealing member is a unitary elastomeric member with the slot 120 formed therein. Accordingly, forces exerted on the contact pads 124 are transmitted into other portions of the sealing member 110.

Figure 2:
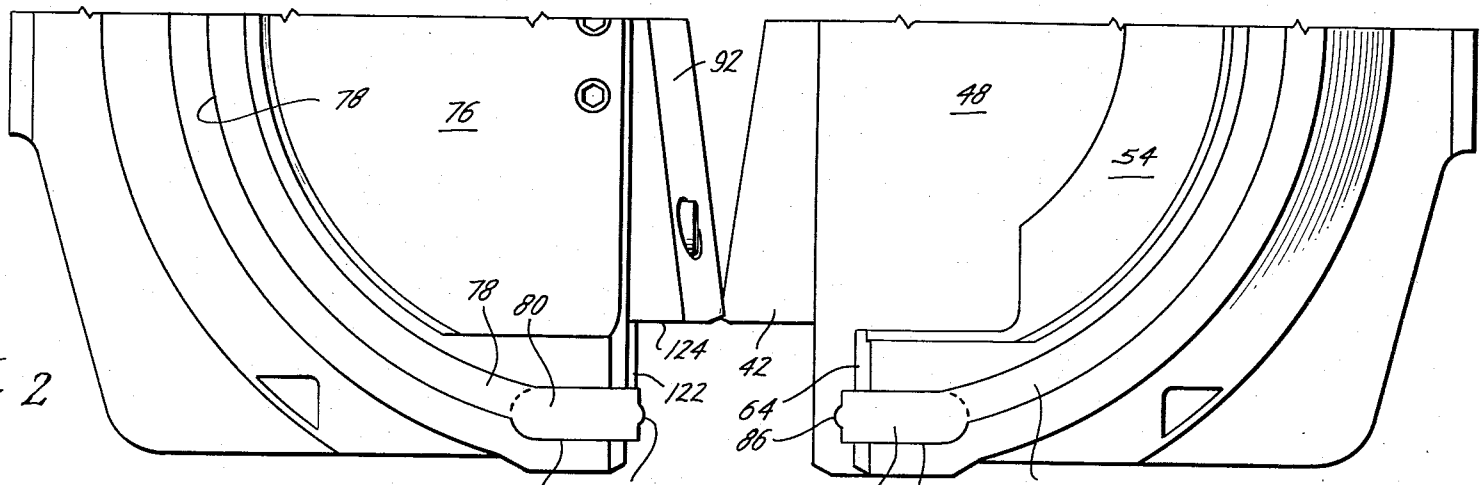
FIG. 2 is a partial plan view of the rams of FIG. 1 in position for shearing an object.

The contact pads 124 extend outwardly from the carrier block 70 a suitable distance in the unengaged position (FIG. 2), providing a surface for contact with the contact faces 64. Upon such contact, further relative movement between the rams S and R begins displacement of elastomer from the contact pads 124 into the portions 116 and 118.

Figure 7:
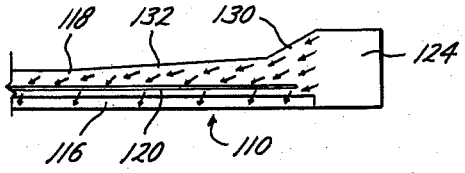
FIG. 7 is a schematic diagram of elastomer flow in forming a seal in rams according to the present invention.
Figure 8:
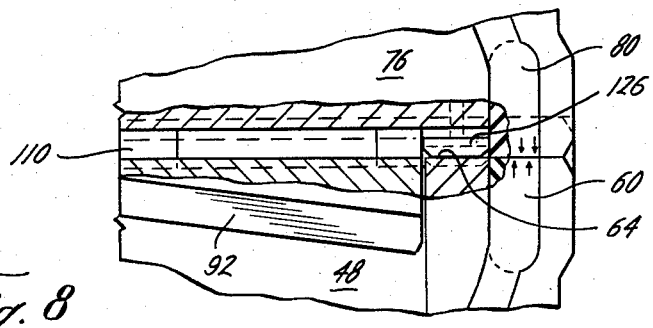
FIG. 8 is a cross-sectional view of portions of the rams of FIG. 6.

The upper portion 118 of the seal member 110 tapers inwardly from the contact pad 124 in order to channel the flow of elastomer in the upper portion 118 of the seal member 110 as indicated schematically in FIG. 7. The tapering of portion 118 begins at a first substantial tapering along a portion 130 thereof and second more gradual tapering along a portion 132 thereof to a midpoint 134. Suitable surfaces 136 and 138 are formed on the carrier block 70 and similarly on the rear surface of the shear blade 92 to ensure confinement of the elastomer material of the seal member 110 within these tapering portions.

If desired, a suitable transverse stiffener member may be mounted in the sealing portion 116 of the seal member 110, as shown at 140 in the drawings, to prevent extrusion of the material thereof by means of pressure within the well bore 10 after sealing has been effected between the rams S and R.

During the operation of the present invention, the object T is sheared by the shear blades 42 and 92 in response to fluid pressure on the pistons 30. In the event that the bore 10 is to be sealed in the absence of an object therein and the rams R and S are thus to serve as "blind" rams, such rams are moved relative to each other by fluid pressure. Initial contact is made between the ribs 86 of the ram R and the ram S. Thereafter, contact is made between the head or front portions 80 and 60 of such rams, forming vertical seal along the bore 10 between the rams S and R. Upon further relative movement between the rams R and S, elastomer displacement will occur in the elastomer material of the sealing members 58 and 78, forming a seal between the upper faces of the rams S and R with the body 12 of the blowout preventer B.

Shortly thereafter, the contact faces 64 of the ram R engage the contact faces 124 of the elastomer material of the seal 110 at each end thereof. Further movement of the ram R with respect to the ram S displaces the elastomer material of the contact faces 124 downwardly and laterally across the upper forcing member 118 of the seal member 110. Due to the presence of the transverse slot 120 between the upper portion 118 and the lower sealing portion 116 of the seal member 110, displacement of the elastomer from the contact pad 124 occurs in a transverse direction (as is seen in FIG. 7) in the upper portion 118. However, the presence of the transverse slot permits the formation of contact planes between the upper forcing portion 118 and the lower sealing portion 116 so that displacement of elastomer transversely in the upper forcing member 118 is transferred according to the present invention into substantially downward displacement of the sealing member 116 forcing the sealing member 116 from a recessed position within the ram S downwardly to engage the surface 114 of the ram R, forming a transverse seal between the ram S and the ram R across the bore 10 of the blowout preventer B.

Displacement of the seal 110 in response to movement between the ram R and S continues until metal engagement is formed between the contact face 64 of the ram R and a metal contact surface 142 (FIG. 5) in the ram S, thereby preventing further relative movement between the rams R and S. However, adequate elastomer displacement has occurred into the inner portion of the seal 110 and into the upper seals 58 and 78 to compensate for any seal damage which may have previously occurred by feeding reserve elastomer into the damaged areas.

The foregoing description and disclosure of the present invention is illustrative and explanatory thereof and various changes in the size, shape and material, as well as in the illustrated construction of the preferred embodiment may be made without departing from the spirit of the invention.

We claim:

1. A ram adapted for movement in a blowout preventer transversely to a bore of the blowout preventer to shear an object in the bore in conjunction with another ram and to thereafter seal the bore, comprising:

(a) a carrier block for movement to and from the bore;

(b) a shear blade mounted with an inner portion of said carrier block nearest the bore for shearing the object;

(c) a sealing member mounted between said shear blade and said carrier block for sealing the bore, said sealing member comprising:

(1) a lower sealing portion movable downwardly to the other ram to seal against same;

(2) an upper forcing member responding to relative movement between the ram and the other ram subsequent to shearing to cause the lower sealing portion to move downwardly and seal against the other ram to seal the bore.

2. The structure of claim 1, wherein said lower sealing member and said upper forcing member are spaced from each other by a transverse separation slot forming planar contact surfaces therebetween.

3. The structure of claim 1, wherein said sealing member further includes:

contact pads extending forwardly from said carrier block at outer end portions of said shear blade for engagement with the other ram after shearing of the object.

4. The structure of claim 3, wherein said lower sealing portion, said upper forcing member and said contact pads comprise integral portions of said sealing member.

5. The structure of claim 3, further including:

stiffener means mounted in said contact pads for preventing upward extrusion thereof.

6. The structure of claim 3, further including:

support pins mounted in said contact pads and extending into support sockets formed in said carrier block for supporting said sealing member in position.

7. The structure of claim 1, further including:

a receiving slot formed in said shear blade member and said carrier block for receiving said sealing member.

8. The structure of claim 7, wherein said receiving slot for receiving said forcing member is of a first height at outer portion thereof and decreases in height to a lesser height at a center portion thereof.

9. The structure of claim 1, further including:

ram carrier means for moving said ram through the blowout preventer.

10. The structure of claim 1, further including:

top seal means mounted with said ram for sealing between said ram and the blowout preventer.

11. The structure of claim 10, further including:

stiffener means bonded in said top seal means for stiffening same.

12. The structure of claim 1, wherein said sealing member is recessed within said carrier block and said shear blade during shearing.

13. The structure of claim 1, further including:

means for attaching said shear blade to said carrier block.

14. The structure of claim 1, wherein said means for attaching includes:

(a) said carrier block having a mounting slot formed therein;

(b) said shear blade includes a rearwardly extending mounting tongue for insertion into said mounting slot;

(c) means for connecting said mounting tongue bar to said carrier block.

15. The structure of claim 1, wherein said means for attaching includes:

fastener means insertable through openings in a front portion of said shear blade and extending rearwardly therethrough for attaching said shear blade to said carrier block.

16. A shearing ram for shearing an object in a bore of a blowout preventer in conjunction with another ram, comprising:

(a) a carrier block for movement to and from the bore;

(b) a shear blade mounted with an inner portion of said carrier block nearest the bore for shearing the object;

(c) a mounting tongue on said shear blade extending into a slot formed in said carrier block for supporting said shear blade against downward movement on contacting the object during shearing; and (d) fastener means insertable through openings in a front portion of said shear blade and extending rearwardly therethrough for attaching said shear blade to said carrier block;

17. A shearing ram for shearing an object in a bore of a blowout preventer in conjunction with another ram, comprising:

(a) a carrier block for movement to and from the bore;

(b) a shear blade mounted with an inner portion of said carrier block nearest the bore for shearing the object;

(c) fastener means insertable through openings in a front portion of said shear blade and extending rearwardly therethrough for attaching said shear blade to said carrier block.

(d) a mounting tongue extending into a slot formed in said carrier block for mounting said shear blade with said carrier block; and (e) adjustable mounting means for connecting said mounting tongue and said carrier block with said shear blade in a position assuring appropriate spacing from the other ram for shearing.

18. A blowout preventer having a ram adapted for movement in a blowout preventer transversely to a bore of the blowout preventer to shear an object in the bore in conjunction with another ram and to thereafter seal the bore, comprising:

(a) a carrier block for movement to and from the bore;

(b) a shear blade mounted with an inner portion of said carrier block nearest the bore for shearing the object;

(c) a sealing member mounted between said shear blade and said carrier block for sealing the bore, said sealing member comprising:

(1) a lower sealing portion movable downwardly to the other ram to seal against same;

(2) an upper forcing member responding to relative movement between the ram and the other ram subsequent to shearing to cause the lower sealing portion to move downwardly and seal against the other ram to seal the bore.

19. The blowout preventer of claim 18, further including:

a second ram having a shearing member mounted therewith for shearing the object in conjunction with said shear blade.

20. A blowout preventer having a shearing ram for shearing an object in a bore of the blowout preventer in conjunction with another ram, comprising:

(a) a carrier block for movement to and from the bore;

(b) a shear blade mounted with an inner portion of said carrier block nearest the bore for shearing the object;

(c) a mounting tongue on said shear blade extending into a slot formed in said carrier block for supporting said shear blade against downward movement on contacting the object during shearing; and (d) fastener means insertable through openings in a front portion of said shear blade and extending rearwardly therethrough for attaching said shear blade to said carrier block.

21. The blowout preventer of claim 20, further including:

a second ram having a shearing member mounted therewith for shearing the object in conjunction with said shear blade.

22. A blowout preventer having a shearing ram for shearing on object in a bore of the blowout preventer in conjunction with another ram, comprising:

(a) a carrier block for movement to and from the bore;

(b) a shear blade mounted with an inner portion of said carrier block nearest the bore for shearing the object;

(c) fastener means insertable through openings in a front portion of said shear blade and extending rearwardly therethrough for attaching said shear blade to said carrier block.

(d) a mounting tongue extending into a slot formed in said carrier block for mounting said shear blade with said carrier block; and (e) adjustable mounted means for connecting said mounting tongue and said carrier block with said shear blade in a position assuring appropriate spacing from the other ram for shearing.

23. The blowout preventer of claim 22, further including:

a second ram having a shearing member mounted therewith for shearing the object in conjunction with said shear blade.

24. A sealing member for mounting behind a shear blade in a blowout preventer ram to seal the bore of a blowout preventer in conjunction with another ram, comprising:

(a) a lower sealing portion movable downwardly to the other ram to seal against same; and (b) an upper forcing member adapted to respond to relative movement between the ram and the other ram subsequent to shearing to cause the lower sealing portion to move downwardly and seal against the other ram to seal the bore.

25. The sealing member of claim 24, wherein said lower sealing member and said upper forcing member are spaced from each other by a transverse separation slot forming planar contact surfaces therebetween.

26. The sealing member of claim 24, wherein said sealing member further includes:

contact pads extending forwardly from said carrier block at outer end portions of said shear blade for engagement with the other ram after shearing of the object.

27. The sealing member of claim 26, wherein said lower sealing portion, said upper forcing member and said contact pads comprise integral portions of said sealing member.

28. The sealing member of claim 26, further including:

stiffener means mounted in said contact pads for preventing upward extrusion thereof.

29. The sealing member of claim 26, further including:

support pins mounted in said contact pads for extending into support sockets formed in a carrier block of the ram for supporting said sealing member in position.

30. A shear blade for mounting with a slotted carrier block of a ram in a blowout preventer to shear an object in a bore of the blowout preventer, comprising:

(a) a shear blade member for shearing the object;

(b) said shear blade member having front and rear portions;

(c) a mounting tongue formed on said rear portion of said shear blade member and extending rearwardly therefrom for insertion into a slot of the carrier block for supporting said shear blade member against downward movement on contacting the object during shearing;

(d) said shear blade member having openings formed therethrough from said front portion to said rear portion for insertion of fastener means for attaching said shear blade member to the carrier block.

31. The shear blade of claim 30, further including:

a plurality of downwardly extending openings formed in said mounting tongue for receipt of adjustable mounting means for connecting said shear blade member to the carrier block in a position assuring appropriate spacing for shearing.

* * * * *